United States Patent [19]

Ota et al.

[11] 4,159,822

[45] Jul. 3, 1979

[54] WORKING MECHANISM FOR A TREATMENT TABLE

[75] Inventors: Sadayasu Ota, Kyoto; Keizo Inoue, Uji, both of Japan

[73] Assignee: Kabushiki Kaisha Morita Seisakusho, Kyoto, Japan

[21] Appl. No.: 881,627

[22] Filed: Feb. 27, 1978

[30] Foreign Application Priority Data

Sep. 12, 1977 [JP] Japan ..... 52-110229

[51] Int. Cl.[2] ..... A61G 13/00

[52] U.S. Cl. ..... 269/325

[58] Field of Search ..... 269/322-326; 254/93 HP, 122; 108/144; 297/354, 355, DIG. 8; 92/8-12

[56] References Cited

U.S. PATENT DOCUMENTS

| | | | |
|---|---|---|---|
| 1,344,037 | 6/1920 | Heymann | 254/93 HP |
| 3,089,692 | 5/1963 | Blomquist | 269/323 |
| 3,521,861 | 7/1970 | Freudenthal et al. | 254/93 HP |
| 3,845,945 | 11/1974 | Lawley et al. | 269/323 |
| 3,868,103 | 2/1975 | Pageot et al. | 269/325 |

*Primary Examiner*—Robert C. Watson

*Attorney, Agent, or Firm*—Koda and Androlia

[57] ABSTRACT

A working mechanism for moving a treatment table including an expandable and contractable pneumatic spring coupled to the table, a pneumatic control pressure circuit for controlling the expansion and contraction of the pneumatic spring and a hydraulic checker coupled to the treatment table whereby the treatment table is smoothly moved and maintained at any heighth.

12 Claims, 9 Drawing Figures

WORKING MECHANISM FOR A TREATMENT TABLE

BACKGROUND OF THE INVENTION

1. Field of Invention

This invention relates to working mechanisms for treatment tables and more particularly to pneumatic type working mechanisms for moving a treatment table.

2. Prior Art

In conventional treatment tables, the working mechanisms for the purpose of raising and lowering the treatment table bed or laying down and putting up the backboard of the treatment table or bed are roughly classified into two species. One of the species is the screw jack-system working mechanism in which the raising and lowering motion is effected by the rotation of a screw rod driven by an electric motor. The other is a hydraulic working mechanism which causes the raising motion by feeding oil into a hydraulic cylinder from a hydraulic pump which is direct coupled to a motor and which brings about the stopping and raising and lowering motions by means of an electromagnetic valve and the like provided in the oil pressure circuit.

There are many controversial points, however, in the utilization of such kinds of working mechanisms as described below. Namely, there is a fear of deterioration of the electric insulating parts during the course of a long time which would result in electric leakage or shock and in particular this is an acute problem for dental use wherein the table is very likely to be located very near to a water circuit. Secondly, in order to prevent a accidental electric leakage or shock, frequent inspection and subsequent replacement of insulating parts is necessary and this results in a considerable loss of time and expenditure required for such inspection and replacement. Thirdly, vibration and noise brought about by the rotation of the motor give an offensive sensation to both the doctor and the patient and in particular the screw-jack type working mechanism causes a greater discomfort as a result of jars created by the grating jack. Fourthly, in hydraulic working mechanisms it is feared that oil leakage will occur which will cause a decrease in the oil pressure or oil stains on the floor of the office wherein the treatment table is located. Fifthly, if such mechanisms are exported world wide, it would be very often required to change the design of the motors according to the rated voltage of the country of destination.

To overcome the above difficulties, it has been considered to replace the hydraulic cylinder with a gas pressure cylinder. Such a system while solving some of the above problems creates problems of its own. Such problems include that the gas pressure cylinder must be larger than the oil pressure cylinder which results in a larger table size; the gas pressure cylinder results in a larger stopping shock; the actual stopping position of the treatment table is at some significant distance past the desired position; and the pneumatic cylinder makes allowed exhaust sound.

SUMMARY OF THE INVENTION

Accordingly it is the general object of the present invention to provide a working mechanism for moving a treatment table which smoothly moves the treatment table, has a secure stopping position and which is significantly safer.

In keeping with the principles of the present invention, the objects are accomplished by a unique working mechanism for causing motion of a treatment table including an expandable and contractable pneumatic spring coupled to the table, a pneumatic control pressure circuit for controlling the expansion and contraction of the pneumatic spring and a hydraulic checker coupled to the treatment table whereby the treatment table is smoothly moved and maintained at any heighth.

BRIEF DESCRIPTION OF THE DRAWINGS

The above mentioned features and objects of the present invention will become more apparent by reference to the following description taken in conjunction with the accompanying drawings wherein like reference numerals denote like elements and in which.

DETAILED DESCRIPTION OF THE INVENTION

Figure 1:
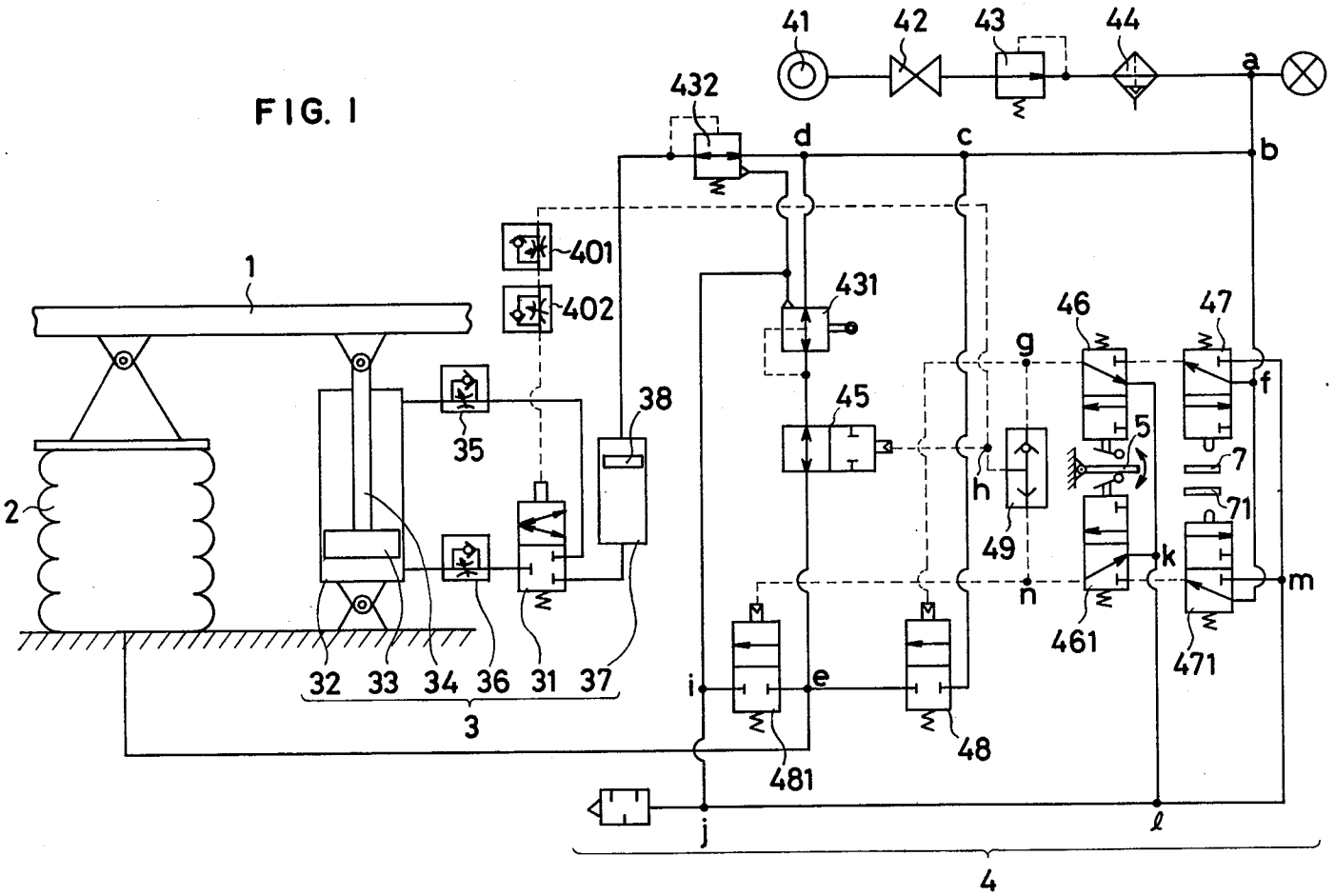
FIG. 1 is a diagram illustrating a working mechanism in accordance with the teachings of the present invention.

Referring to FIG. 1, shown therein is a working mechanism for moving a treatment table in accordance with the teachings of the present invention. As shown in FIG. 1, the working mechanism includes a pneumatic spring 2 which expands and contracts by the dint of gas pressure for raising and lowering or stopping a treatment table 1. A hydraulic checker 3 is provided in parallel with pneumatic spring 2 and a gas pressure circuit 4 causes the pneumatic spring 2 to expand and contract. The hydraulic checker 3 insures smooth raising and lowering of the treatment table 1 and regulates the raising and lowering speed thereof by working independently of the expanding and contracting motion of the pneumatic spring 2 in response to the pilot gas from the gas pressure circuit 4 when the treatment table 1 is being raised and lowered by the expanding and contracting of the pneumatic spring 2. The hydraulic checker 3 also in response to pilot gas from the gas pressure circuit 4 functions as a stopper for securing the stopping position of the treatment table 1 when the treatment table 1 is stopped and the pneumatic spring 2 is being maintained at a prescribed internal gas pressure by the gas pressure circuit 4.

In the present embodiment, a pneumatic spring 2 of the bellows type is shown and is preferred since it is readily available at a reasonable price, yields a suitable thrust, is not too large, is durable, etc. It should be apparent that a sleeve type of other well known pneumatic spring could also be used. For the hydraulic checker 3, an oil pressure type is the most popular and is preferable. In addition to oil pressure type hydraulic checkers, air oil type hydraulic checkers, which are well known could also be used. In addition, even though the present invention is described in terms of a single pneumatic spring 2 and a single hydraulic checker 3, it would also be possible to use a plurality of either of them.

In FIG. 1 is shown the stopping state of the working mechanism in accordance with the teachings of the present invention wherein the compressed gas, usually at a pressure of about 7 kg/cm$^2$, is fed from a gas source 41, (usually an air compressor) through a valve 42. The gas is decompressed (usually to a pressure of 3.5 kg/cm$^2$,) by a primary regulator valve 43 and then fed to a secondary regulator valve 431 through connecting points a,b,c, and d after being purified by a filter 44. After being decompressed by the secondary regulator valve 431 for the second time (usually to a pressure of about 3 kg/cm$^2$), the gas is supplied to the pneumatic spring 2 through an open type working valve 45 and that connecting point e. By this means, the interior of the pneumatic spring 2 can be maintained at a constant gas pressure. The gas pressure in the interior of the pneumatic spring 2 is regulated by the secondary regulator valve 431 is fixed to a gas pressure necessary for the pneumatic spring 2 to support the total dead weight load of the treatment table 1 and a patient's body weight added thereto (i.e., usually a pressure of about 1.3 kg/cm$^2$. In this stopping state, pilot gas is not fed to the working valve 31 of the hydraulic checker to indicate an open valve condition and the oil pressure circuit is closed. Accordingly, the oil in the hydraulic cylinder 32 cannot circulate and the piston 33 remains fixed at one position and the treatment table 1 is kept at a fixed height since it is connected to the piston 33 via a piston rod 34. In such a stopping state, the hydraulic checker 3 exhibits the function as a stopper for securing the stopping position of the treatment table 1 which is in contrast to its other function.

Referring now to the situation where the treatment table 1 is raised, the raising operation is conducted by pushing up pedal 5 to open valve 46. As previously described, part of the gas after being decompressed and purified is supplied as a pilot gas to a normally closed type gas working valve 48 for raising through connecting points a,b, and f, a limit valve 47, valve 46 and connecting point g by opening valve 46 thereby causing working valve 48 to open. Concurrently with this, part of the pilot gas branches off at connecting point g, passes through a shuttle valve 49 and again branches off at a connecting point h. This pilot gas causes working valve 45 to close while the other portion of the pilot gas is fed to working valve 31 in the hydraulic checker through gas flow controlling valves 401 and 402 to cause valve 31 to open. In this manner, when the valve for raising is opened by pushing up the pedal 5, valve 45 which has been open until that time is closed for the purpose of feeding secondary decompressed gas to the pneumatic spring 2 and gas working valve 48 for raising is open so that compressed gas which has been primarily decompressed and purified is supplied to the pneumatic spring 2 through the connecting point a,b, and c, the gas working valve 48 and the connecting point e. The pneumatic spring 2 is expanded by the gas pressure supplied by the compressed gas and the gas working valve 31 of the oil pressure circuit is opened. Therefore it is possible for oil to circulate in the hydraulic cylinder 32. As a result hydraulic checker 3 works together with the expanding motion of the pneumatic spring 2.

Referring particularly to the motion of the hydraulic checker 3, to begin with the formation of the oil pressure circuit is effectuated by opening gas working valve 31 in response to the pilot gas. This pilot gas whose flow is regulated by the gas flow controlling valve 402 opens the gas working valve 31 little by little. Accordingly, the amount of oil circulating in the oil pressure circuit is small at the first stage of the expanding motion of the pneumatic spring 2. In other words, during the short time from the beginning of the opening of control valve 402 up to the completion of its opening, the amount of oil circulating in the oil pressure circuit is small. For this reason, the hydraulic checker 3 begins slowly to work and prevents sudden expanding motion of the pneumatic spring 2 so that shock at the beginning of raising the treatment table member is eliminated. As the working operation begins smoothly in this manner, the piston 33 moves upwardly dependent on the expanding motion of the pneumatic spring 2 while the oil around the rod above the piston in the hydraulic cylinder 32 begins to circulate through an oil flow controlling valve 35, a working valve 31 and a oil flow controlling valve 36 and at last enters oil chamber under the piston in the hydraulic cylinder 32. At this point, the shortage of oil produced in the lower oil chamber is eliminated automatically by replenishing the oil in the lower oil chamber from a balance cylinder 37. To the balance cylinder 37 is supplied part of the purified gas which passes through connecting point a,b,c, and d and the regulator valve 432. The purified gas supplied to balance cylinder 37 is at a pressure which is reduced to less than the circulating oil pressure sent out by the hydraulic cylinder 32 which is always supplied to the free piston 38 inside the balance cylinder 37. Furthermore, the regulation of the rising speed can be performed at will by the use of the oil flow controlling valve 35 by regulating the flow of oil circulating from the upper oil chamber of the hydraulic cylinder 32 to the lower chamber of the hydraulic cylinder 32.

In addition to the above described function, the hydraulic checker 3 acts as a stopper. In such a stopping state, as shown in FIG. 1, where the pedal 5 for raising and lowering of the gas pressure circuit is put in a neutral position. When the pilot gas giving the indication to open the gas working valve 31 at the time of rising is exhausted through the gas flow controlling valve 402 and 401, the connecting point h, the shuttle valve 49, the connecting point g, the valve 46 for raising, the connecting points k, l, and j and a muffler 6, the oil pressure circuit is broken. At this point, there is little stopping shock because the exhaust of the pilot gas is conducted by the gas flow controlling valve 401 little by little and the gas working valve 31 is gradually closed.

Description is now directed to the case where the treatment table 1 is lowered. The lowering operation is carried out by pushing down the pedal 5 to open a valve 461 for lowering. To be prescise, compressed gas supplied from the gas source 41 is delivered as a pilot gas to the gas working valve 41 for the lowering through the connecting point ab and f, limit valve 471 for lowering, the valve 461 for lowering and the connecting point n by opening the valve 461 for lowering. Since the gas working valve 41 is open, the pilot gas which is branched off at connecting point n passes through the shuttle valve 49 and is branched off again to be fed to the respective gas working valves 45 and 31 so that working valve 45 is closed as in the case of the raising operation and the working valve 31 is gradually opened. In this way, when the working valve 45 of the gas circuit pressure valve 4 is closed and the gas working valve 481 for lowering is opened, then the secondary reduced compressed gas supplied to the pneumatic spring 2 in the stopping state ceases to be supplied and the gas body in the pneumatic spring 2 is exhausted through the connecting point e, the gas working valve 481 for lowering, the connecting points i, j, and the muffler 6 under the dead load of the treatment table 1 and the body weight of the patient thereby leading to the contraction of the pneumatic spring 2. Since the oil pressure circuit is formed in the hydraulic checker 3 by opening the gas working valve 31, the circulation of oil leaving the lower oil chamber of the hydraulic cylinder 32 for its upper chamber and the movement of superflouos oil from the lower oil chamber to the balance cylinder 37 is possible and the lowering of piston 33 is brought about in conjunction with the contracting motion of the pneumatic spring 2. Since the regulation of the raising speed is controlled by the oil flow controlling valve 35 (as mentioned above), the lowering speed is controlled by the oil flow controlling valve 36.

When the pedal for raising and lowering is put in a neutral position and the valve 461 for lowering is closed, the whole apparatus returns to the stopping state as shown in FIG. 1, that is, each of the pilot gases for the gas working valves 31, 45 and 41 to open or close, close together at the connecting point n, passes through the valve 461 for lowering, the connecting points k, l, and j and is discharged out of muffler 6. Thereby, as mentioned in the foregoing description, the secondarily reduced gas pressure is supplemented into the pneumatic spring 2 while the hydraulic checker 3 functions as a stopper for insuring the stopping point of the treatment table 1. Incidentally, opening and closing of the gas working valve 31 and the hydraulic checker 3 is formed by controlling valves 401 and 402, so that the shock can be somewhat more completely absorbed both at the starting time and the stopping time of lowering. This is the same function as was described in the description of the rising motion.

To this point, only a detailed description of the action of the working mechanism in accordance with the teachings of the present invention has been described for its three states, stopping, raising and lowering. As can be seen in the exampled diagram in FIG. 1, an upper limit valve 47 and a lower limit valve 471 are incorporated into the gas pressure circuit for the purpose of defining limits for raising and lowering. In operation, limit valves 47 and 471 are open to enable compressed air coming from the gas source 41 to be fed to the valve 46 for raising or the valve 461 for lowering through the limit valves 47 and 471 so long as the treatment table member 1 performs its rising and falling motion within certain limits. Therefore, the raising and lowering can be conducted with freedom within the above mentioned limits if the pilot gas is fed to each of the gas working valves 31, 45, 48 or 481 by operation of the pedal 5 for raising and lowering to open the valve 46 for raising and the valve 461 for lowering. When this raising or lowering movement, however, reaches either an upper or a lower fixed position (normally the allowed highest position of the raising or the allowable lowest position of lowering), the upper limit valve 47 of the lower limit valve 471 is operated by the working pieces 7 and 71 to cut the gas feeding circuit from the gas source 41 to the valves 46 or 461 for raising or for lowering and forming instead an exhaust circuit for the pilot gas ( a circuit where the pilot gas flows together at the connecting point g or m) and is exhausted out of the muffler 6 through the valves 46 or 461 for raising or for lowering, the upper or lower limit valve 47 or 471 and the connecting points n, l and j. When the pilot gas is exhausted, each of the gas working valves 31, 45, 48 or 41 is changed over to the stopping state wherein the raising or falling motion of the treatment table 1 stops regardless of the operation of the pedal for raising and for lowering.

Figure 2:
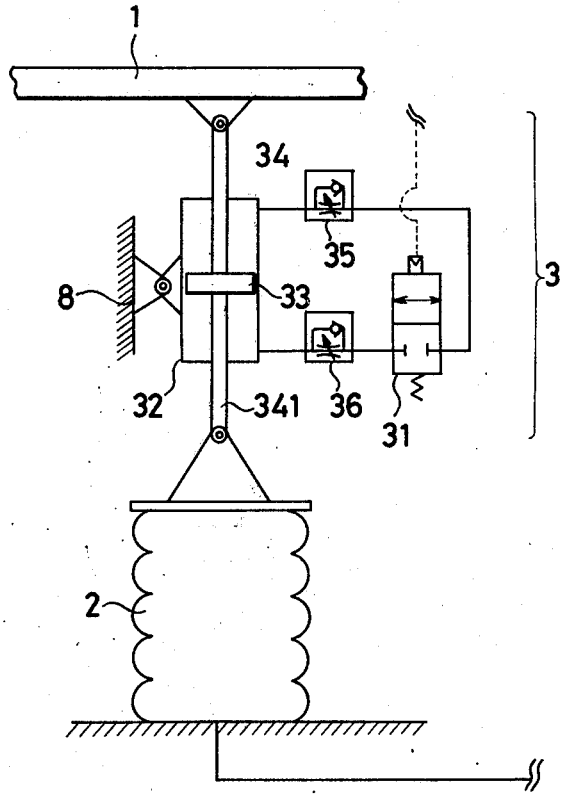
FIG. 2 is a diagram showing part of another example of a working mechanism in accordance with the teachings of the present invention.

Referring to FIG. 2, shown therein is a diagram partially illustrating another embodiment of the working mechanism according to the teachings of the present invention. In this embodiment the pneumatic spring 2 and the hydraulic checker 3 are arranged in series relative to the treatment table 1. As for the hydraulic checker 3, its hydraulic cylinder 31 is fixedly and rotatably mounted at a suitable place 8 on the treatment table 1 and in addition to its piston rod 34 another rod 341 is provided at the underside of the piston 33. The lower end of the lower rod 341 is rotatably connected to a coupling part on the top of pneumatic spring 2. In such a manner if the rods 34 and 341 are provided in series on both upper and lower sides of piston 33, the balance cylinder 37 or the pressure circuit for the cylinder 34 such as is shown in FIG. 1 becomes unnecessary. Furthermore, since the actions of the pneumatic spring 2, and the hydraulic checker 3 and the gas pressure circuit controlling the pneumatic spring 2 and the hydraulic checker 3 are substantially the same as in FIG. 1, the description of the actions of such members will be omitted.

In this working mechanism in accordance with the teachings of the present invention, if such things as the gas source 41, the valve 42, the primary reducing valve 43 and the filter 44 are disposed outside of the consulting room and at the same time the pneumatic spring 2, the hydraulic checker 3 and the gas pressure circuit 4 are built inside the treatment table 1, it becomes unnecessary to incorporate an electric circuit in the interior of the treatment table so that a fear of incurring any electrical leakage or shock is eliminated. Therefore, the working mechanism of the present invention not only insures safety but also avoids losses in time and money required for the replacement of insulating parts or regular inspection. Furthermore, since the working mechanism 10 functions without any electrical circuit, it is not required to design special working mechanisms for working mechanisms exported to other countries which are dependent upon the country of destination. In addition, the working mechanism can be made small and still have satisfactory trust even at a pressure of about 3.5 $kg/cm^2$ so long as the pneumatic spring 2 is of the bellows type. Furthermore, the working mechanism of the present invention provides a high durability and makes possible semi-permanent use while expanding and contracting under the pressure of 3.5 $kg/cm^2$ compressed gas. Besides the working mechanism according to this invention is not a type which is actuated or stopped by a single independently operating pneumatic spring 2 but is so designed to be used in combination with a hydraulic checker 3. Therefore, the raising and falling motion of the treatment table 1 or the laying down and putting in motion of its backboard is performed smoothly and the stopping motion is perfectly secured simultaneously with the stoppage of the hydraulic checker 3 which functions as the stopper. In addition, since the gas working valve 31 of the hydraulic checker 3 is gradually opened and closed by controlling the flow of the pilot gas with the use of the gas flow controlling valves 401 and 402, there is felt no shock at all both at the starting and stopping time of the motion. On the other hand, the working speed can also be controlled to any desired speed with the help of the oil flow controlling valve 35 and 36. Moreover, if a suitable muffler 6 is furnished on the end of the exhaust passage, the discharge of gas in the pneumatic spring 2 and the pilot gas is exercised noislessly so that the heretofore inevitable perplexing problem of noise is solved once and for all and the comfort of both the doctor and the patient is insured.

Parenthetically, even though the piston rod 34 of the hydraulic cylinder 32 mediating between the pneumatic spring 2 and the hydraulic checker 3 is represented in the above described examples for the sake of convenience of explanation as being coupled directly to the treatment table 1, in practice some suitable means for raising and lowering or for laying down and putting up are preferably provided between the treatment table 1 and the piston rod 34, pneumatic spring 2 and hydraulic checker 3.

Figure 3:
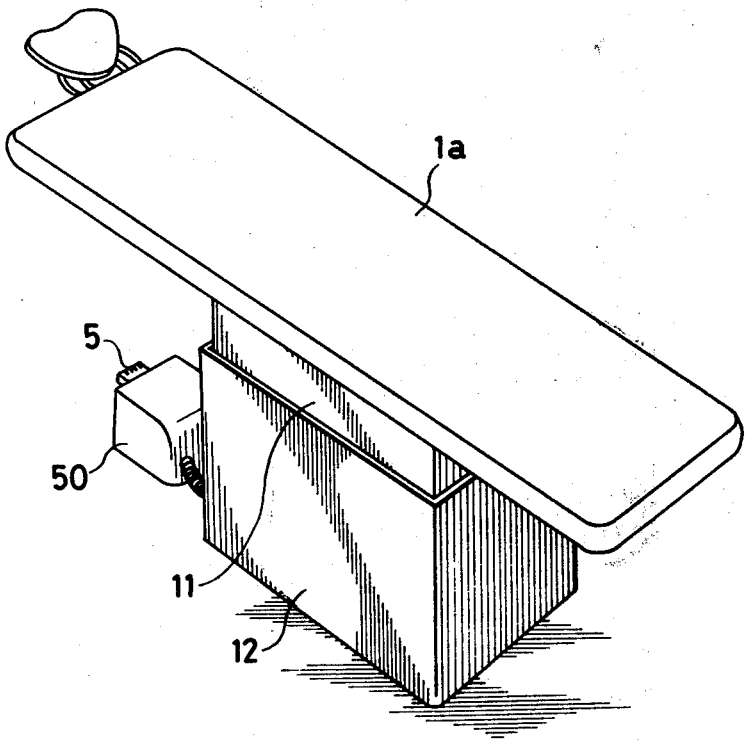
FIG. 3 is a perspective view illustrating an example of a treatment table apparatus in accordance with the teachings of the present invention.
Figure 9:
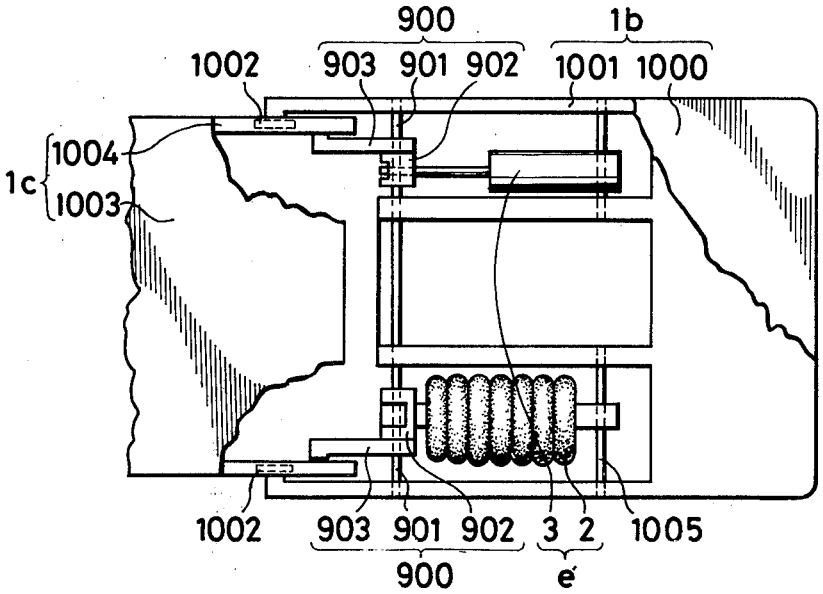
FIG. 9 is a partially cut-away plan view of the chair type treatment table apparatus of FIG. 8.

Description is now directed to a treatment table apparatus incorporating the above described working mechanism in conjunction with FIGS. 2, 3 and 9.

Figure 4:
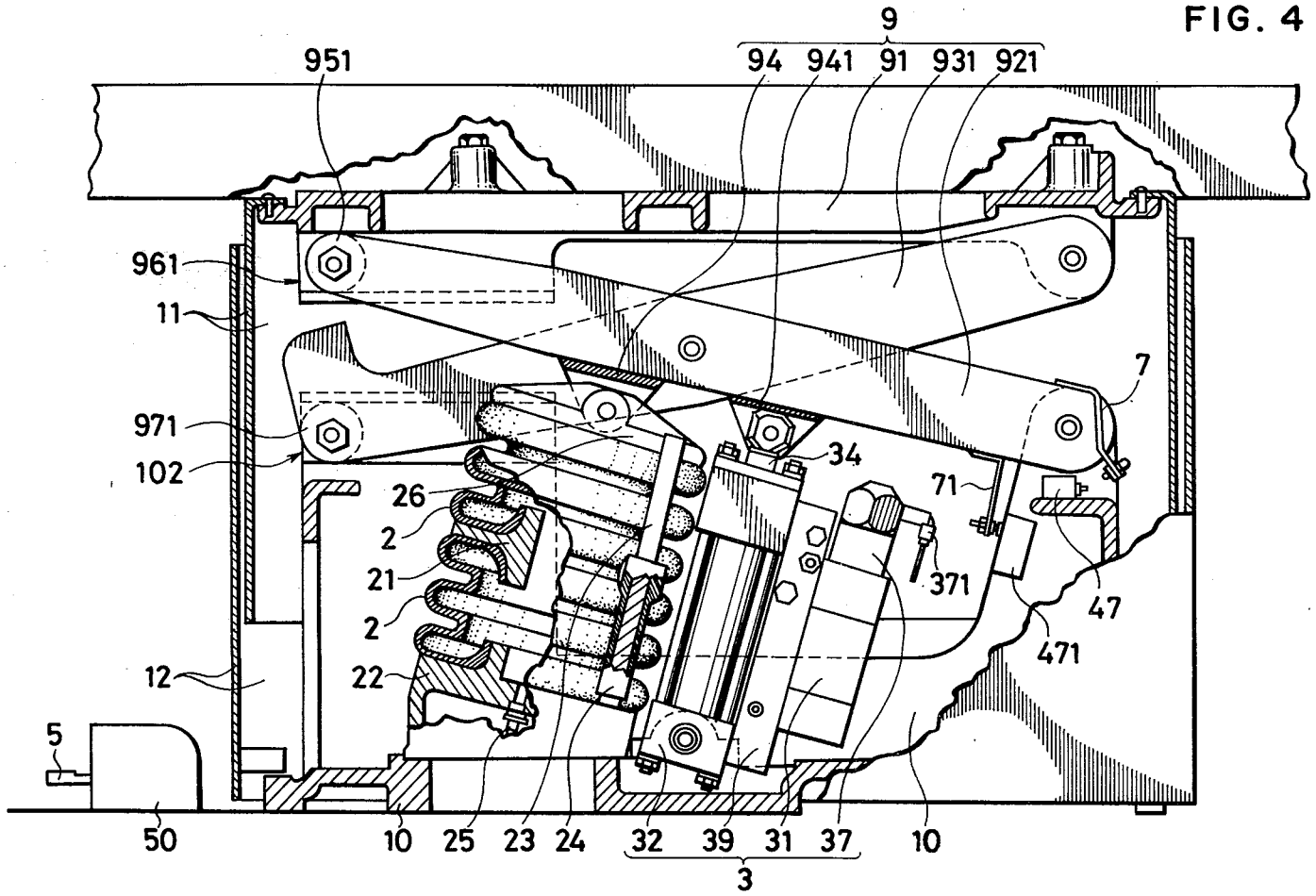
FIGS. 4 and 5 are partially cut-away longitudinal sectional front views and a cut-away left side view respectively showing the principal parts of the treatment table for the case where the treatment table is in the lowest position.
Figure 5:
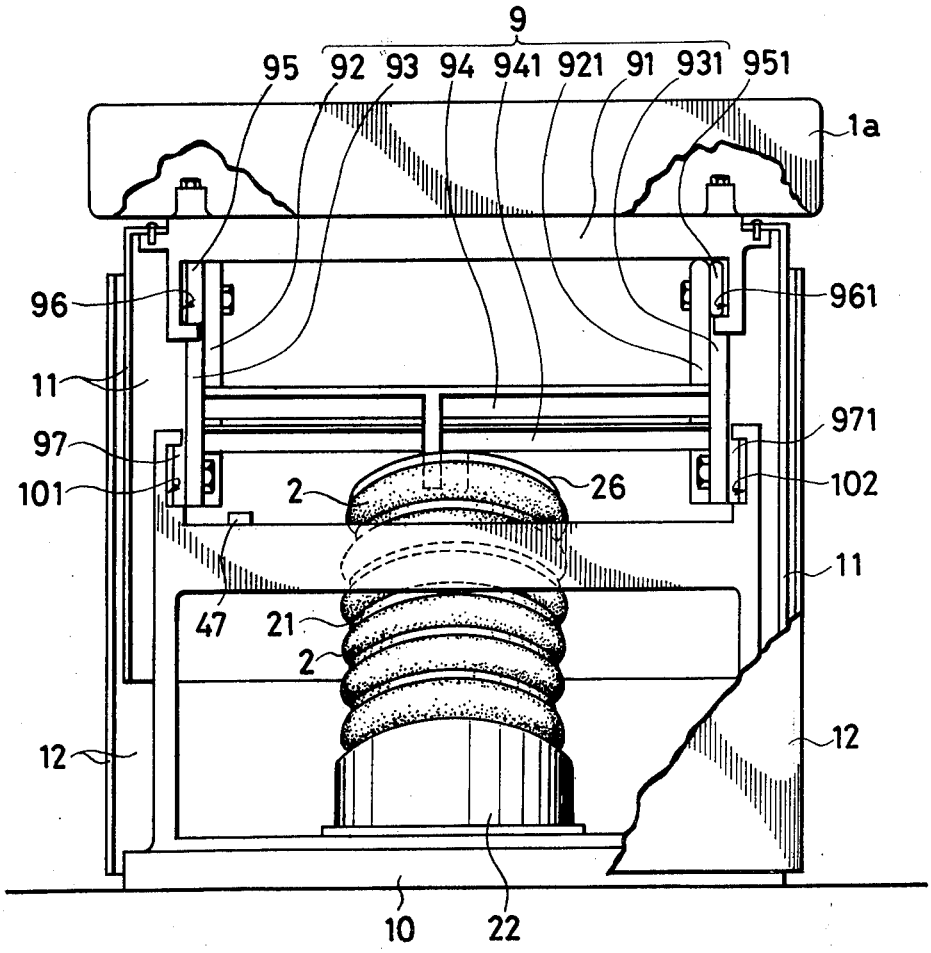
Figure 6:
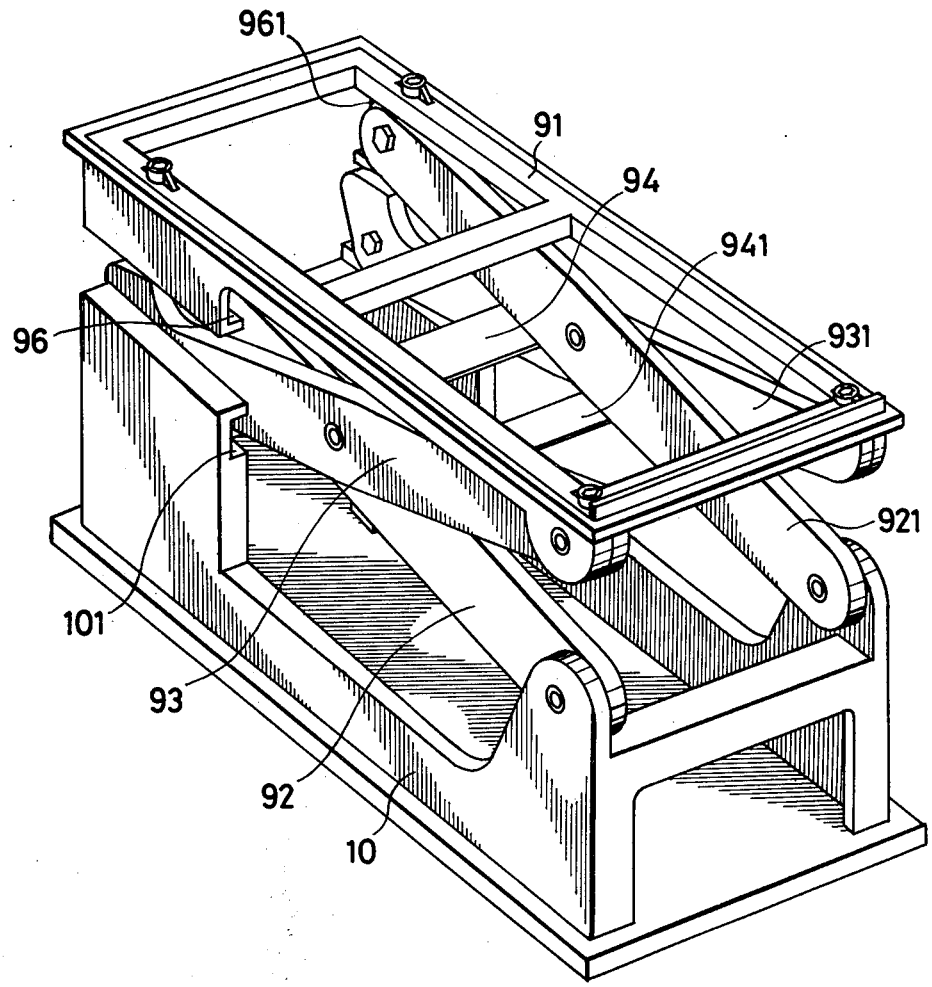
FIG. 6 is a perspective view illustrating themtically extracting only the pedestal and the means for raising and lowering the treatment table out of the treatment table.
Figure 7:
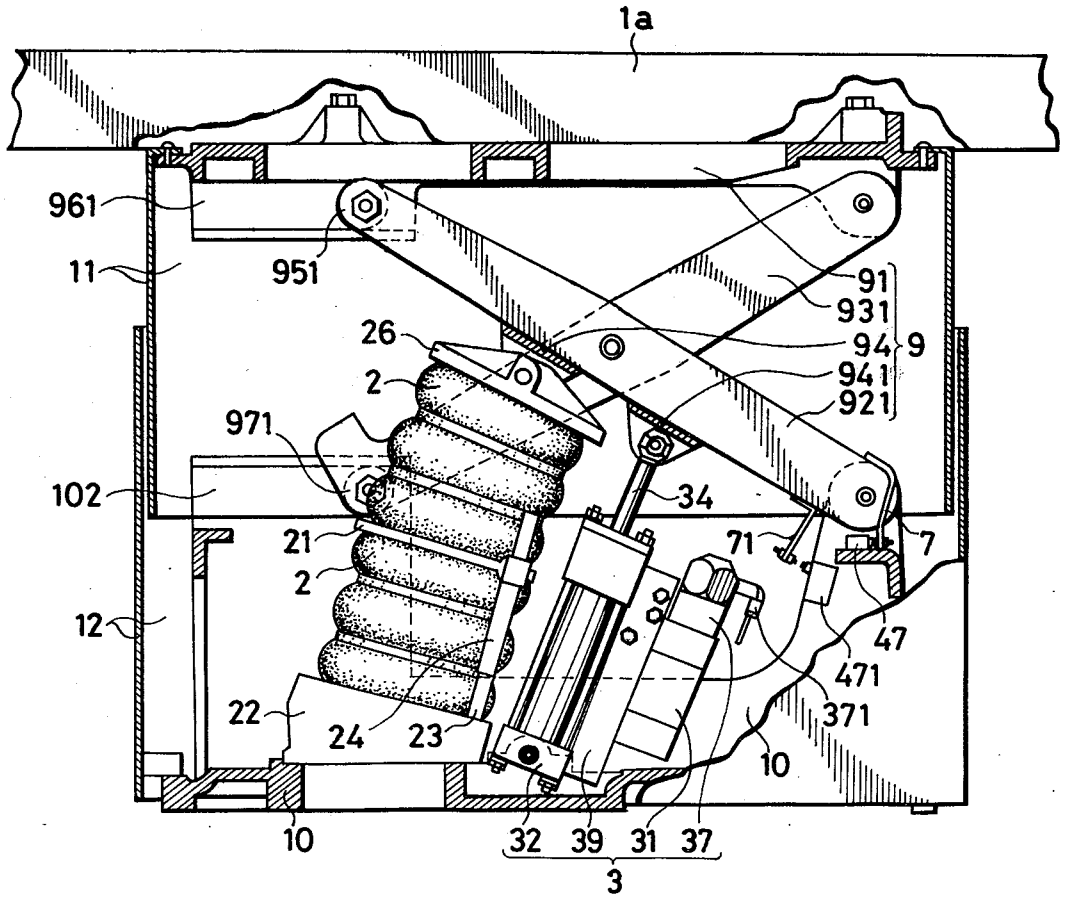
FIG. 7 is a partially cut-away longitudinal sectional front view showing the principal part of the treatment table wherein the treatment table is raised to the highest position.
Figure 8:
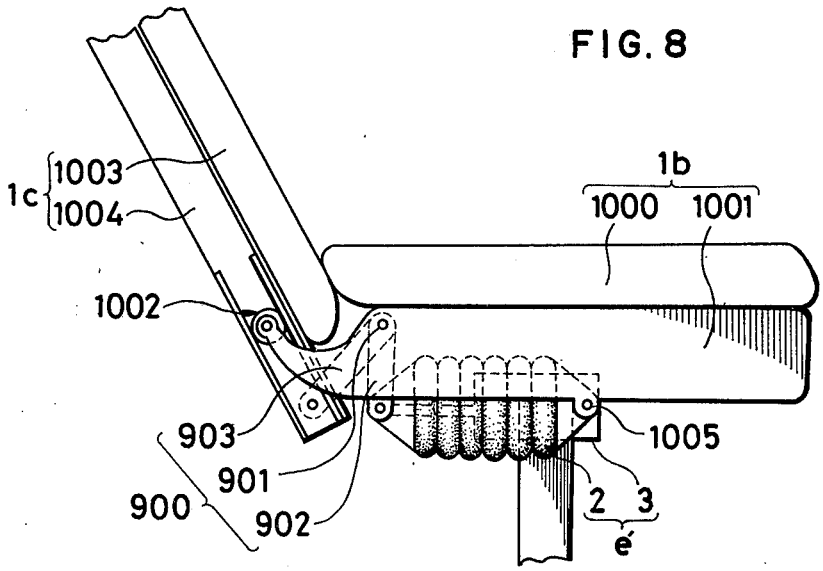
FIG. 8 is a left side view showing part of an example of a chair type treatment table apparatus wherein the backboard is made raisable and lowerable by a working mechanism in accordance with the teachings of the present invention.

Referring to FIG. 3, shown therein is a perspective view illustrating one example as a treatment table apparatus for dental use of a sitting treatment position type as it is called wherein a treatment table bed provided with the working mechanism in accordance with the teachings of the present invention is mounted ascendably and descendably. Referring to FIGS. 4 and 5, shown therein are respective partially cut-away longitudinal sectional front and left side views illustrating the principal parts of the treatment table apparatus in the case where the bed lies in the lowest position. Referring to FIG. 6, shown therein is a perspective view illustrating the treatment table apparatus while extracting therefrom only its pedestal and means for raising and lowering. Referring to FIG. 7, shown therein is a partially cutaway longitudinal front view showing the principal parts of the treatment table apparatus for the situation where the bed is raised to the highest position. Referring to FIG. 8, shown therein is a left side view in part showing by way of example the chair type as is called of the treatment table apparatus equipped with the working mechanism in accordance with the teachings of the present invention wherein a backboard is attached such that it is able to be laid up and put down with ease. Referring to FIG. 9, shown therein is a partially cutaway plan view of the chair type treatment table apparatus.

In FIGS. 3 through 7, the treatment table includes a treatment table bed 1a to be raised and lowered, a pedestal 10, a working mechanism e provided in the pedestal 10 for raising and lowering the treatment table which consists of a pneumatic spring 2, a hydraulic checker 3 and a gas pressure circuit (not shown), means for raising and lowering arranged between the working mechanism e and the bed 1a, inner and outer housings 11 and 12 enclosing the pedestal 10, the working mechanism e for raising and lowering the means 9 for raising and lowering.

In this treatment table apparatus, as shown in FIGS. 4 and 5, two bellows type pneumatic spring 2, upper and lower, both inter-connected air tightly at the middle of 21 are fixed slantingly on the pedestal 10 through the medium of a mounting seat 22. The reason why the pneumatic spring 2 is slantingly mounted is for the purpose of efficiently adding the thrust of the pneumatic spring 2 at the time of the expansion to the working links 92 and 921 of the means 9 for raising and lowering as hereinafter described. On the mounting seat 22 is provided at the same inclination a guide rod 23 whereon is set a sliding cylinder 24 connected to the middle seat 21. This sliding cylinder 24 is so designed to be able to freely slide along the guide rod 23 in concert with the expanding and contracting motion of the pneumatic spring 2. This sliding cylinder 24 is for preventing the bending of the connecting part of the middle seat 21 during the time of expanding and contracting of the pneumatic spring 2. Inside of the seat 22 is buried a joint 25 through which the pneumatic spring 2 and the gas pressure circuit (not illustrated) is then connected.

Further, in this treatment table apparatus wherein the hydraulic checker 3 and the pneumatic spring are arranged in parallel the lower end of the hydraulic cylinder 32 is mounted rotatably on the pivot provided on the pedestal 10 while the upper end of the piston 34 is provided rotatably on the bridging arm 941 of the means 9 for raising and lowering. To the flank of the hydraulic cylinder 32 is attached a casing 39 having the oil flow controlling valve 35 and 36 built in and still further to the flank of the casing 39 is attached the working valve 31 and over, above and to the flank of the gas working valve 31 is attached the balance cylinder 37 in one piece therewith. The balance cylinder 37 is provided with a joint 371 to which is connected one end of the gas pressure circuit to apply the fixed gas pressure to the free piston 38 within the balance cylinder 37.

On the other hand, the means for raising and lowering comprises, as shown in FIG. 6, a supporting frame 91 bearing the treatment table bed which is fastened thereto, two sets of working links 92 and 921 and guide links 93 and 931, front and rear, intersecting slantingly and being rotatably pivoted at the rear part of each other and two bridging arms 94 and 941 connecting the front and rear working links 92 and 921.

Each lower and front and rear working links 92 and 921 is pivoted rotatably on the pedestal 10 while each upper end of the front and rear working links 92 and 921 is pivoted by way of rollers 92 and 951 (see FIGS. 4 and 5) which are each inserted in respective transverse grooves 96 and 961 provided in parallel in the supporting frame 91. As a result, the upper end of the working links 92 and 921 are able to slide freely along the supporting frame 91. The guide links 93 and 931 are each pivoted at the upper end on the supporting frame 91 while the lower end of the guide links 93 and 931 is pivoted with rollers 97 and 971 which are inserted into respective transverse grooves 101 and 102 provided in the pedestal 10. As a result, the lower ends of the guide links 93 and 931 are able to slide freely on the pedestal 10 and the parallel and longitudinal direction to the supporting frame 91. The bridging arms 94 and 41, as shown in FIG. 4, are each provided at about their middle parts with respective pivots projecting downwardly to which are attached one and (upper lid) of the pneumatic spring 2 and the piston rod 34 of the hydraulic checker 3.

In the above described means 9 for raising and lowering, when a pneumatic spring 2 receives the primarily reduced compressed gas from the gas pressure circuit to expand, each of the front and rear working links 92 and 921 receives the thrust from the pneumatic spring through the bridging arm 94 and begins to rotate with its other end acting as a fulcrum (in the case illustrated, clockwise). With this rotation, its upper end slides inwardly along the supporting frame 91 while tracing the transfers grooves 96 and 961 in the frame 91. Simultaneously each of the front and rear guide links 93 and 931 slides inwardly on the pedestal 10 while pushing its own lower end with the roller 97 and 971 against the transverse grooves 101 and 102 in the pedestal 10 and rotating in opposition to the rotating direction of the working links 92 and 921 with its upper end pivoted to the support frame 91 as a fulcrum. In doing so, the supporting frame 91 rises smoothly in a vertical direction while being supported by the rollers 95 and 951 on the upper end of the working links 92 and 921 and the pivoted upper ends of the guide links 93 and 931 until at last the supporting frame 91 reaches the allowable highest position for raising (see FIG. 7). It goes without saying that the lowering movement is carried out by the above described motion in reverse. In other words, the means 9 for raising and lowering has the ability of converting the expanding and contracting motions of pneumatic spring 2 into a stable raising and lowering motion in the vertical direction.

If such means 9 for raising and lowering described above is adopted, as shown in FIGS. 4 and 7, the limits for raising and lowering can be established with extreme simplicity by arranging the previously described upper and lower valve 47 and the lower limit valve 471 used for setting the upper and lower limits of the raising and lowering adjacent to either of the end parts of the working links 92 and 921 and attaching the ends of the working links 92 and 921 to the previously described working pieces 7 and 71 to actuate the limit valves 47 and 471 to thereby make the working piece 7 press upon the upper limit valve 47 at the time of rising to the highest position or conversely making the working piece 71 press upon the lower limit valve 471 to work at the time of falling to the lowest position (see FIG. 4). By the above described means, there is also an additional advantage of being able to adjust or modify the limits of raising or lowering easily and in accordance with changed circumstances.

Furthermore, in this treatment table apparatus, the outer housing 12 is layed or fixed on the fringe of the pedestal 10 while the inner housing 11 is fixed to the rim of the supporting frame 91. The inner housing 11 ascends and descends along with the treatment table bed 1a mounted on the supporting frame 91. However, both housings are so constructed as to maintain a partial overlapping even when the treatment table bed 1a is raised to its highest position so that the internal structure of the apparatus is never laid bare and a clean appearance continues to be kept. Also in this treatment table apparatus the casing 50 with the built in valves for raising and lowering in the gas pressure circuit and the pedal 5 for raising and lowering to open these valves are arranged outside of the housing 11 and 12 for the purpose of providing convenient raising and lowering operating but they may be provided within the housing if occasion demands.

Referring to FIGS. 8 and 9 shown therein is a chair type treatment table apparatus. The chair type treatment table apparatus includes a seat **1*b*, a backboard 1*c* combined sinkably and erectably with the seat 1*b* through the medium of a means 900 for laying down and putting up and a mechanism e prime for laying down and putting up which includes a pneumatic spring 2, and a hydraulic checker 3 and a gas pressure circuit (not illustrated) which are all provided under the seat 1*b***.

The seat **1*b* consists of a seat mattress 1000 and a seat frame 1001 supporting the mattress 1000. At the left and right rear ends of the seat frame 1001, a pair of rollers 1002 are pivoted rotatably. Indirectly under the seat frame 1001 and at either the left or right sides are provided a multi-stage bellows type spring 2 and a hydraulic checker 3 in parallel and horizontally. The respective parts near the bottoms of the pneumatic spring 2 and the hydraulic checker 3 are rotatably mounted to pins 1005 and the front end parts are pivoted on either of two cranks provided on the left and right sides. The backboard consists of a backboard pad 1003 and a backboard 1004 carrying the pad 103. The rollers 1002 are fitted slidably into grooves provided on both lower side parts of the backboard frames 1004 which are rotatably pivoted at their lower parts with the front parts of the working links 903 of the means 900**.

The means 900 for laying down and putting up adopted in this apparatus consists of a rotatable link rod 901 passing from left to right at a position adjacent to the rear end of the seat frame 1001 on the side of the backboard 1003, a pair of cranks 902, left and right, fastened to the link rod 901 and a pair of working links 903, left and right, fixed to the link rod 901 and forming a prescribed included angle with the cranks 902. On the left and right cranks 902 are pivoted the respective front ends of the pneumatic spring 2 and the hydraulic checker 3 and the front ends of the left and right working links 903 are pivoted rotatably on the lower end parts of the backboard frame 1004. When the pneumatic spring 2 expands, hydraulic checker 3 interlocks, the cranks 902 and the working links 903 rotate clockwise with the link rod 901 as a center while keeping the prescribed angle therein between. As a result, the backboard frame 1004 begins to rise gradually while being guided by the rollers 1002 and slides upwardly. Conversely, when the pneumatic spring 2 contracts and the hydraulic checker 3 interlocks, the cranks 90 and the working links 903 rotate counterclockwise. As a result the backboard frame 1004 starts to fall slantingly little by little while being guided by the rollers 1002 and sliding downwardly.

In a chair type treatment table apparatus of this sort, in addition to the previously mentioned noticeable effects obtained, there can also be achieved further desirable results. The desirable results achieved are that the circular movement of the backboard frame 1004 at the time of the backboard's being laid down and put up obviates the head or back of the patient slipping along the backboard pad 1003 before and after the laying down and putting up motion. In addition the amount of problems with the working mechanism in accordance with the present invention are greatly reduced as a result of its simplicity of construction.

It should be apparent to one skilled in the art that the above described embodiments are merely illustrative of but a few of the many possible specific embodiments which represent the application of the principles of the present invention. Numerous and varied other arrangements can readily be devised by those skilled in the art without departing from the spirit and scope of the invention.

We claim:

1. A working mechanism for moving at least a portion of a treatment table comprising:
   - an expandable and contractable pneumatic spring coupled to said table;
   - a hydraulic checker coupled to said treatment table; and
   - a pneumatic control pressure circuit for controling the expansion and contraction of said pneumatic spring and for controling said hydraulic checker whereby the treatment table is smoothly moved and easily maintained in any position.

2. A mechanism according to claim 1 wherein said pneumatic spring is a bellows-type.

3. A mechanism according to claim 1 wherein said hydraulic checker is arranged and configured such that said hydraulic checker can only move when a pilot gas is sent out by said pneumatic control pressure circuit when said table is caused to move.

4. A working mechanism as set forth in claims 1, 2, or 3, wherein said pneumatic spring and said hydraulic checker are arranged in series.

5. A working mechanism as set forth in claims 1, 2, or 3, wherein said pneumatic spring and said hydraulic checker are arranged in parallel.

6. A working mechanism as set forth in claim 1, wherein a plurality of said pneumatic springs and said hydraulic checkers are provided.

7. A treatment table apparatus comprising:
   - a treatment table bed to be raised and lowered;
   - a pedestal;
   - a working mechanism for raising and lowering installed within said pedestal;
   - a means for raising and lowering arranged between said working mechanism for raising and lowering and said lowering and said treatment table bed; and
   - inner and outer housings enclosing the pedestal, said mechanism for raising and lowering, and said means for raising and lowering, said working mechanism for raising and lowering comprising a pneumatic spring expanding and contracting by dint of the gas pressure for use in raising, lowering, and stopping said treatment table bed, a gas pressure circuit to effectuate the expanding an contracting motion of said pneumatic spring, and a hydraulic checker, said working mechanism arranged and configured to ensure and control by the working of said hydralic checker the smooth motion and the working speed of the treatment table bed at the time of its rising and falling due to the expanding and contracting motion of said pneumatic spring, and to secure the stopping position of the treatment table bed at the time of its stopping subsequently to the stoppage of said pneumatic spring through the suspension of said hydraulic checker functioning now in the capacity of a stopper.

8. A treatment table apparatus as set forth in claim 7, wherein said pneumatic spring is a bellows-type.

9. A treatment table apparatus as set forth in claim 7 wherein said means for raising and lowering comprises a supporting frame fixedly secured to the treatment table bed in order to support the latter, two sets of working links and guide links, front and rear, slantly intersecting each other and pivoted together on the middle part, and two bridging arms interconnecting said front and rear working links; said front and rear guide links being pivoted at their upper ends on said supporting frame and being mounted with their lower ends on the pedestal slidably in the parallel and longitudinal direction to said supporting frame; said front and rear working links being mounted with their upper ends on said supporting slidably in the parallel direction thereto and being pivoted at their lower ends on said pedestal; and said two bridging arms being pivoted, on one hand, with one end of said pneumatic spring and, on the other hand, with the one end of the piston rod of said hydraulic checker; thus said means for raising and lowering being so deviced as to be able to raise and lower the treatment table bed in the vertical direction through the expanding and contracting motion of said pneumatic spring.

10. A treatment table apparatus in the form of a chair, a seat, a backboard pivoted on said seat sinkably and electably through the aid of a means for laying-down and putting-up, and a working mechanism for laying-down and putting-up provided directly under said seat; wherein said working mechanism for laying-down and putting-up comprises a pneumatic spring expanding and contracting by dint of the gas pressure in order to lay-down, put-up, or stop said backboard, a gas presusre circuit effectuating the expanding and contracting motion of said pneumatic spring, and a hydraulic checker, said working being arranged and configured to ensure and control by the working of said hydraulic checker the smooth motion and the speed of the backboard at the time of its being laid-down and put-up owing to the expanding and contracting motion of said pneumatic spring, and, on the other hand, to secure the stopping position of the backboard through the suspension of said hydraulic checker functioning now in the capacity of a stopper at the time of the backboard coming to a standstill subsequently to the abeyance of the expanding and contracting motion of said pneumatic spring.

11. A treatment table apparatus as set forth in claim 10, wherein said pneumatic spring is of a bellows-type.

12. A treatment table apparatus as set forth in claim 10, wherein said means for laying-down and putting-up comprises a rotatable link rod passing through left-to-right at a position adjacent to the rear end of the seat frame, a pair of cranks, left and right, fastened to said link rod, and a pair of working links, left and right, fixed on said link rod while forming a prescribed included angle with aforesaid cranks; a pair of said cranks, left and right, being pivoted with the respective front ends of said pneumatic spring and said hydraulic checker; and a pair of said working links, left and right, being pivoted each at their front ends on the lower end parts; thereby said means for laying-down and putting-up being so contrived as to be able to lay-down and put-up the backboard by the expanding and contracting motion of said pneumatic spring.

* * * * *